US005100126A

United States Patent [19]

Liou

[11] Patent Number: 5,100,126

[45] Date of Patent: Mar. 31, 1992

[54] HAND-MUSCLE DEVELOPER

[76] Inventor: Chien Hsing Liou, No. 460, Juang-Fu Road, Pei-Tou Chen, Chang-Hua Hsien, Taiwan

[21] Appl. No.: 710,535

[22] Filed: Jun. 5, 1991

[51] Int. Cl.[5] ..... A63B 21/045

[52] U.S. Cl. ..... 482/46; 482/124; 482/127

[58] Field of Search ..... 272/67, 135, 137, 139, 272/140, 142; 128/25 R, 77, 26

[56] References Cited

U.S. PATENT DOCUMENTS

| | | | |
|---|---|---|---|
| 4,039,183 | 8/1977 | Sakurada | 272/140 |
| 4,226,412 | 10/1980 | Panepinto | 272/142 |
| 4,310,154 | 1/1982 | Kauffman | 272/142 |
| 4,417,727 | 11/1983 | Ottenheimer | 272/67 |
| 4,585,228 | 4/1986 | Olson | 272/67 |
| 4,589,655 | 5/1986 | Ammon | 272/67 |
| 4,836,531 | 6/1989 | Niks | 272/67 |

*Primary Examiner*—Robert Bahr
*Assistant Examiner*—Lynne A. Reichard
*Attorney, Agent, or Firm*—Bacon & Thomas

[57] ABSTRACT

A hand-muscle developer, comprising a tubular base having a rocker arm pivotably connected thereto at one end by a pair of connecting plates and a pair of links with two pairs of torsional springs respectively retained therebetween. Operator's hand is inserted through the tubular base to hold a cross bar on the rocker arm and to drive it to rotate back and forth. Rotating the tubular base causes the torsional springs to produce a resisting force against the applied force from operator's hand and therefore, operator's hand muscles are trained. Adjusting screws are provided for adjusting the tension of the torsional springs.

4 Claims, 4 Drawing Sheets

HAND-MUSCLE DEVELOPER

BACKGROUND OF THE INVENTION

The present invention relates to hand-muscle developers and relates more particularly to a hand-muscle developer which is convenient to carry and adjustable in strength.

In muscular exercise, a dumb-bell has been commonly used for developing the muscles of the hand. Because a dumb-bell is a standardized product, for different weight training, different specifications or sizes of dumb-bells are required. Further, dumb-bells are heavy and inconvenient to carry.

SUMMARY OF THE INVENTION

The main object of the present invention is to provide a hand-muscle developer which is practical in use for training the muscles of the hand.

It is another object of the present invention to provide a hand-muscle developer which is inexpensive to manufacture and convenient to carry.

It is still another object of the present invention to provide a hand-muscle developer which can be adjusted to satisfy different weight training requirements.

To achieve the above objects, there is provided a hand-muscle developer generally comprised of a tubular base having a rocker arm pivotably connected thereto at one end by a pair of connecting plates and a pair of links with two pairs of torsional springs respectively retained therebetween. Operator's hand is inserted through the tubular base to hod a cross bar on the rocker arm and to drive it to rotate back and forth. Rotating the tubular base causes the torsional springs to produce a resisting force against the applied force from operator's hand and therefore, operator's hand muscles are trained. Adjusting screws are provided for adjusting the tension of the torsional springs.

DETAILED DESCRIPTION OF THE PREFERRED EMBODIMENT

Figure 1:
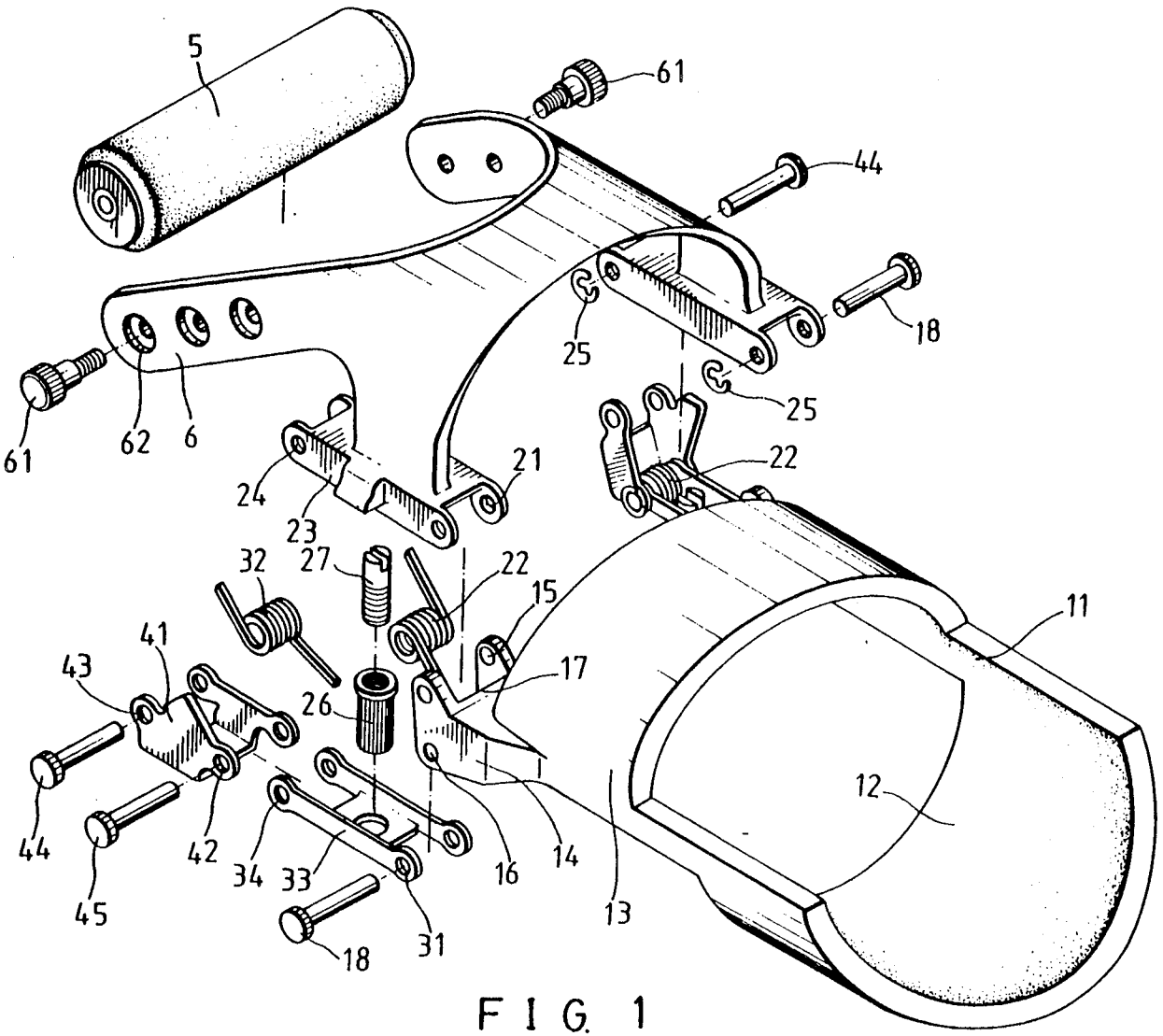
FIG. 1 is a dismantled perspective view of the preferred embodiment of the hand-muscle developer of the present invention.
Figure 2:
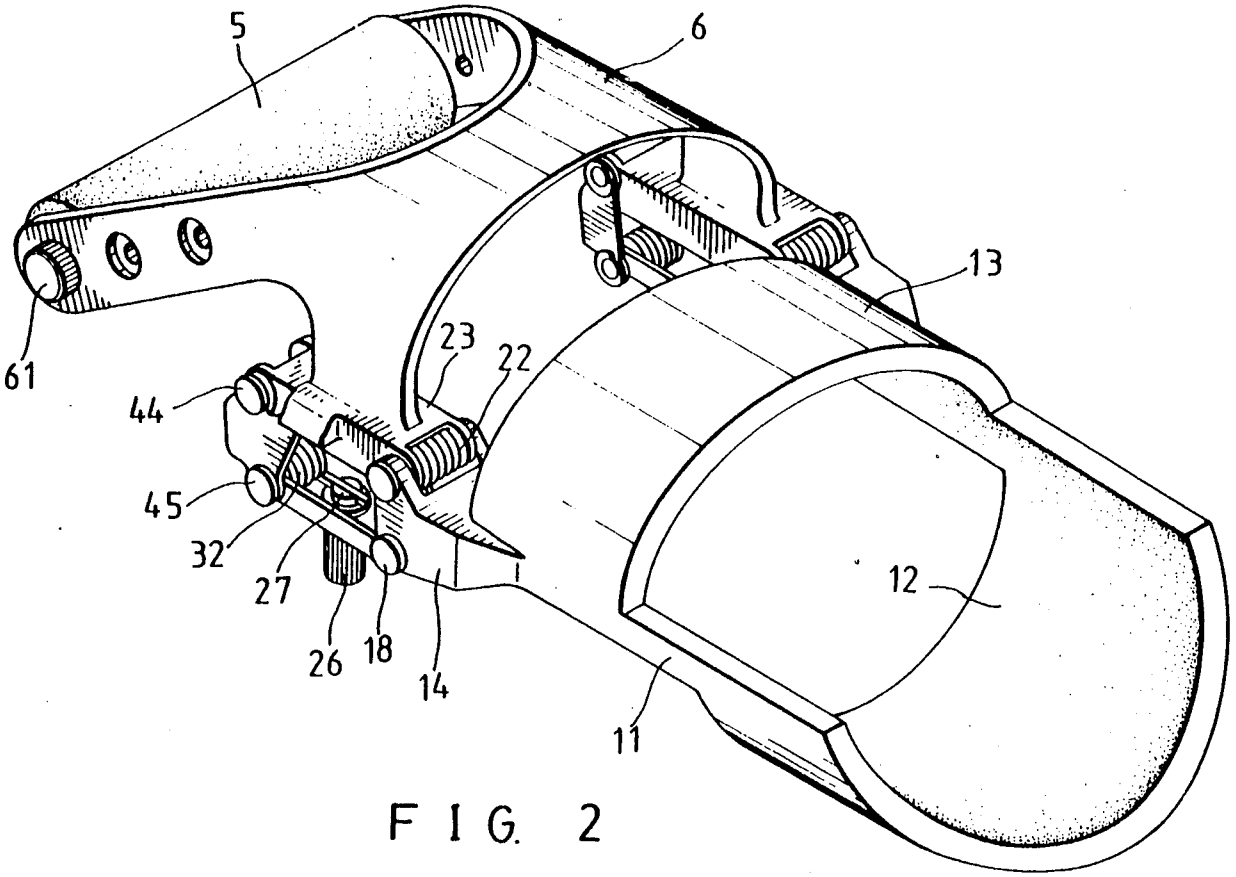
FIG. 2 is a perspective assembly view thereof.

Turning now to the annexed drawings in detail and referring first to FIGS. 1 and 2, there is provided a base 1 which is generally comprised of two symmetrical rod portions 11 longitudinally disposed at two opposite locations, a first arched wall portion 12 connected between said two symmetrical rod portions 11 at one end and a second arched wall portion 13 connected between said two symmetrical rod portions 11 at an opposite end and opposite side relative to said first arched wall portion 12, and two substantially U-shaped brackets 14 respectively made on said two symmetrical rod portions 11 at one end adjacent to said second arched wall portion 13. The two substantially U-shaped brackets 14 have each two pairs of pivot holes 15 and 16 for fastening a rocker arm 6 via a pair of connecting plates 33 and a pair of links 41. The rocker arm 6 has two unitary, opposite connecting members 23 at the bottom which has two pairs of opposite pivot holes 21 and 24 at two opposite ends. Similar to the connecting members 23 on the rocker arm 6, the connecting plates 33 and the links 41 have each two pairs of opposite pivots holes 31 and 34, or 42 and 43 respectively formed at two opposite ends. During assembly, the first pair of pivot holes 31 of each of the connecting plates 33 are respectively pivotably secured to the lower pair of pivot holes 16 of each of the U-shaped brackets 14 by a rivet and a C-shaped retainer ring 25; the second pair of pivot holes 34 of the connecting plates 33 are respectively pivotably secured to the first pair of pivot holes 42 of the links 41 by a rivet 45 and a C-shaped retainer ring 25 each; the second pair of pivot holes 43 of each of the links 41 are respectively pivotably connected to the second pair of pivot holes 24 of each of the connecting members 23 by a rivet 44 and a C-shaped retainer ring 25 each; the first pair of pivot holes 21 of each of the connecting members 23 are respectively pivotably connected to the upper pair of pivot holes 15 of the U-shaped brackets 14 by a rivet 18 and a C-shaped retainer ring 25 each. There are also provided a first pair of torsional springs 22 respectively retained between the connecting members 23 and the U-shaped brackets 14, a second pair of torsional springs 32 respectively retained between the connecting plates 33 and the links 41, and a pair of adjusting screws 26 respectively fastened in the connecting plates 33 to adjust the tension of said second pair of torsional springs 32. The adjusting screws 26 have each a screw rod 27 respectively fastened in a bolt hole 28 on each of the connecting plates 33, which screw rod 27 has a slot 29 on the terminal end thereof. As indicated, the second pair of torsional springs 32 are respectively retained between the connecting members 23 and the links 41, having each one end respectively stopped against the top edge of each of the links 41 and an opposite end stopped at the slot 29 on the screw rod 27 of each of the adjusting screws 26. By turning each adjusting screw 26 on the bolt hole 28 on each connecting plate 33 inwards or outwards, the tension of the corresponding torsional spring 22 is adjusted. Further, the rocker arm 6 has symmetrical hoes 62 on the two front projections thereof for fastening a handlebar 5 therebetween by lock screws 61.

Figure 3:
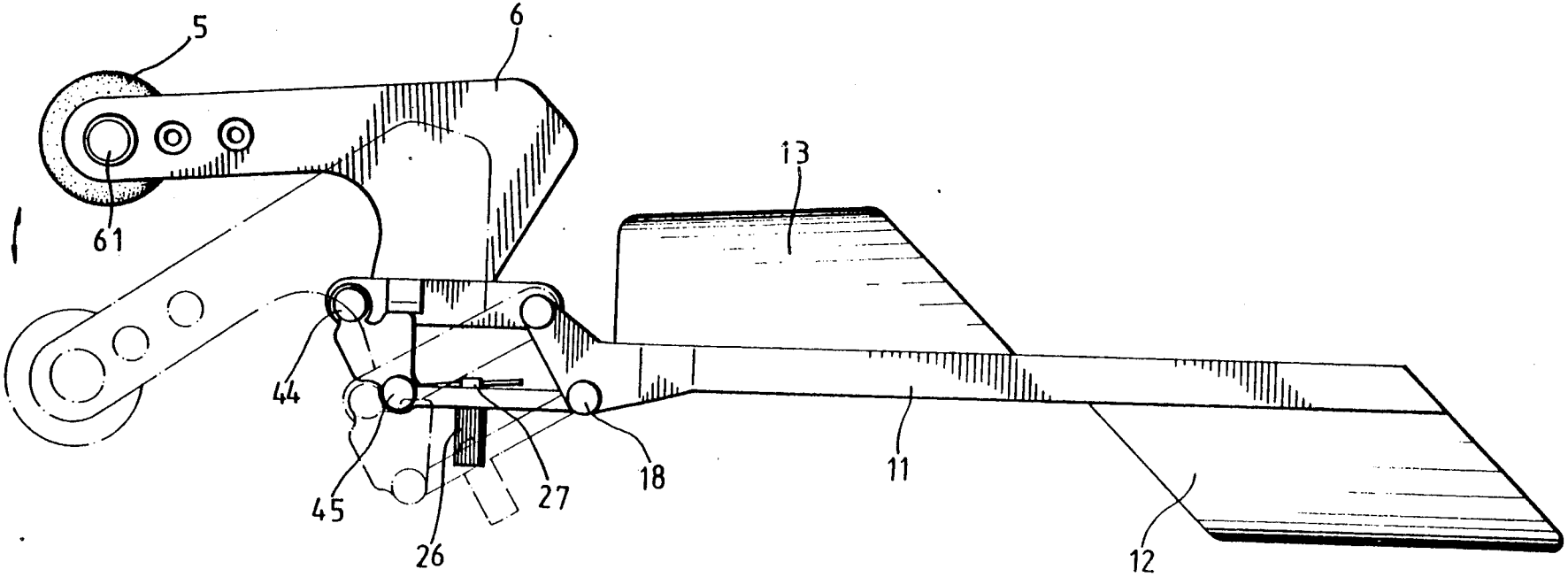
FIG. 3 is a schematic drawing illustrating the operation of the present invention.

Referring to FIG. 3, insert one hand through the first and second wall portions 12 and 13 of the base 1 to hold tight the handlebar 5 on the rocket arm 6 and then, apply force to bend the handlebar 5 downwards (as indicated in the drawing). During bending, the first and second pairs of torsional springs 22 and 32 are squeezed to produce a resisting force and therefore, an operator must apply more force to surpass the resisting force from the first and second pairs of torsional springs 22 and 32. Once the handlebar 5 is moved a lower limit position, stop applying force to the handlebar 5 permitting it to be pushed by the resisting force from the first and second pairs of torsional springs 22 and 32 to move back to former position. Repeating the aforesaid procedure, the muscles of the hand are trained.

Figure 4:
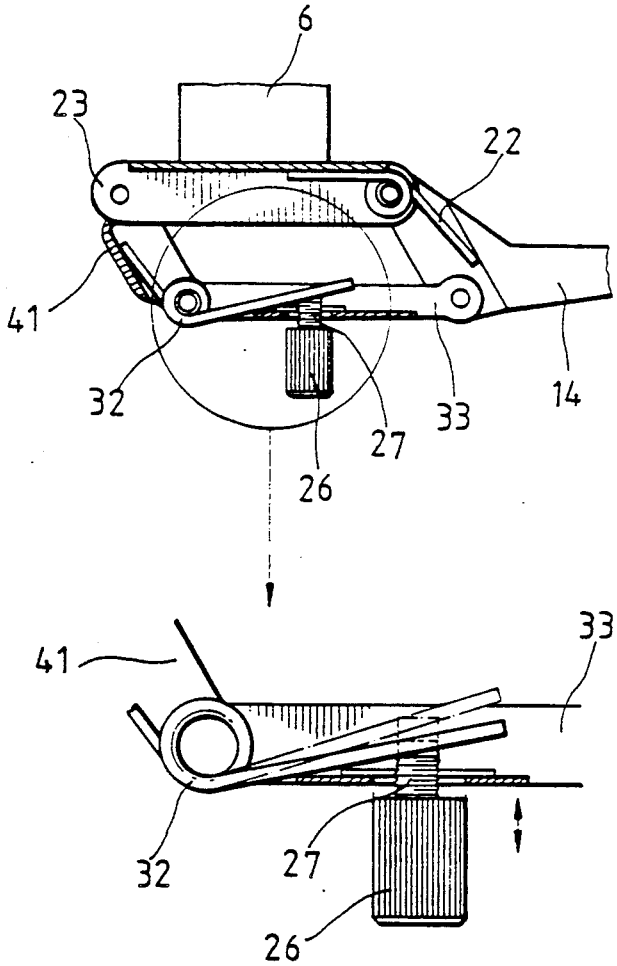
FIG. 4 illustrates an operation to adjust the tension of the second pair of torsional springs by the adjusting screws.

Referring to FIG. 4, turning tight or loosening each adjusting screw 26 causes each screw rod 27 to displace upwards or downwards and therefore, the tension of the corresponding torsional spring 32 is changed. By means of this procedure, the resisting force to the handlebar 5 which is produced during bending operation can be properly adjusted according to personal requirement.

What is claimed is:

1. A hand-muscle developer, comprising:

a base comprised of two symmetrical rod portions longitudinally disposed at two opposite locations, a first arched wall portion connected between said two symmetrical rod portions at one end and a second arched wall portion connected between said two symmetrical rod portions at an opposite end and opposite side relative to said first arched wall portion, and two substantially U-shaped brackets respectively made on said two symmetrical rod portions at one end adjacent to said second arched wall portion, said U-shaped brackets having each a first connecting end at an upper end and a second connecting end at a lower end;

a rocker arm having a hand-hold transversely disposed at one end and two unitary, opposite connecting members at the bottom spaced from said hand-hole, said connecting members having each a first connecting end at one end respectively pivotably connected to the first connecting end on each of said U-shaped brackets and a second connected end at an opposite end;

a pair of connecting plates having each a first connecting end at one end respectively pivotably connected to the second connecting end on each of said U-shaped brackets and a second connecting end at an opposite end;

a pair of links having each a first connecting end at one end respectively pivotably connected to the second connecting end on each of said connecting plates and a second connecting end at an opposite end respectively pivotably connected to the second connecting end on each of said connecting member;

a first pair of torsional springs respectively retained between said two connecting members and said two U-shaped brackets;

a second pair of torsional springs respectively retained between said pair of connecting plates and said pair of links; and a pair of adjusting screws respectively fastened in said pair of connecting members to control the tension of said second pair of torsional springs.

2. The hand-muscle developer of claim 1, wherein said rocker arm is pivotably connected to said base via said pair of connecting plates and said pair of links by rivets and C-shaped retainer rings so that it can be rotated on said base back and forth.

3. The hand-muscle developer of claim 1, wherein said rocker arm has two front projections with said hand-hold connected therebetween by lock screws for the holding of the hand to drive it to rotate on said base back and forth.

4. The hand-muscle developer of claim 1, wherein an operator's hand is inserted through said first and second arched wall portions to hold said hand-hold and to drive it to rotate vertically downward so as to squeeze said first and second pairs of torsional springs causing said first and second pairs of torsional springs to produce a resisting force to force said hand-hold to move back to former position once applied force from operator's hand is released therefrom.

* * * * *